United States Patent [19]

Conley, III et al.

[11] Patent Number: 5,011,363

[45] Date of Patent: Apr. 30, 1991

[54] EXTEND AND RETRACT CONTROL FOR FORK LIFTS

[75] Inventors: Walter Conley, III, St. Marys; Ned E. Dammeyer, New Bremen; Kim A. Klopfleisch, St. Marys, all of Ohio

[73] Assignee: Crown Equipment Corporation, New Bremen, Ohio

[21] Appl. No.: 446,222

[22] Filed: Dec. 5, 1989

[51] Int. Cl.[5] ..... B66F 9/06

[52] U.S. Cl. ..... 414/666; 414/664; 414/670; 414/282; 414/785; 74/471; 180/333; 180/315; 60/551; 187/9 R

[58] Field of Search ..... 74/471, 471 R, 491; 414/635, 640, 663, 785, 667, 671, 283, 286, 909, 630, 467, 666, 4, 664, 628, 469, 629, 631, 470, 665, 659, 668, 673, 642, 282; 244/480, 636.3; 180/333, 315; 212/162, 163, 164, 160, 159; 60/551; 187/9 R, 9 E

[56] References Cited

U.S. PATENT DOCUMENTS

| | | | |
|---|---|---|---|
| 3,179,198 | 4/1965 | Hastings, Jr. | 180/333 X |
| 3,745,966 | 7/1973 | Seager | 74/471 XY X |
| 3,811,336 | 5/1974 | Pulskamp | 414/635 X |
| 3,930,587 | 1/1976 | Bliss | 414/664 |
| 3,937,346 | 2/1976 | Van der Laan | 414/666 |
| 4,218,170 | 8/1980 | Goodacre | 414/667 X |
| 4,470,750 | 9/1984 | Vockinger | 414/666 |
| 4,543,031 | 9/1985 | Luebrecht et al. | 414/665 X |
| 4,699,239 | 10/1987 | Ishino et al. | 180/315 |
| 4,755,100 | 7/1988 | Schultz et al. | 414/642 X |

FOREIGN PATENT DOCUMENTS

| | | | |
|---|---|---|---|
| 2019690 | 11/1971 | Fed. Rep. of Germany | 414/666 |
| 1210349 | 10/1970 | United Kingdom | 414/666 |
| 1417142 | 12/1975 | United Kingdom | 414/667 |

*Primary Examiner*—Frank E. Werner

*Attorney, Agent, or Firm*—Biebel, French & Nauman

[57] ABSTRACT

A fork extension and retraction system for use with stockpickers automatically extends and retracts hydraulically extendable forks of a stockpicker when the load handler carrying the forks has moved to its extended position on the load side of the vehicle, and it also automatically retracts the forks if they have drifted from a home position before performing other fork related activities. Switches in the fork carriage assembly sense when the extendable forks are in the home position and near the home position. Other switches sense when the load handler assembly has reached its extreme positions on either side of the operator's platform. Still other switches are used to slow the traverse movement of the load handler assembly as it approaches its extreme positions, thus to cushion the shock of the load handler stopping. A control circuit senses the condition of these switches and controls the operation of both the load handle and the fork extension hydraulic system.

3 Claims, 8 Drawing Sheets

EXTEND AND RETRACT CONTROL FOR FORK LIFTS

BACKGROUND OF THE INVENTION

This invention relates to fork lift trucks and particularly to an improved apparatus for automatically extending the forks of a turret stockpicker.

A typical turret stockpicker includes a power unit for propelling the vehicle down a aisle and for providing the power necessary to operate auxiliary functions such as the raising, lowering and extending of the forks. A mast on the power unit supports an operator's platform which may be raised and lowered along with the forks. The operator's platform usually includes various handles to control such as steering, braking, and movement of the forks. A load handler assembly is carried by the operator's platform and is movable transversely across the face of the platform between a home position, where any load carried by the forks is centered, and an extended limit position on the load side of the vehicle where the forks extend beyond the sides of the vehicle. A fork carriage assembly is mounted on and is vertically moveable relative to the load handler. The fork carriage assembly may be pivoted on the load handler assembly so that the forks may be pointed either to the right or to the left relative to the vehicle.

This arrangement permits the operator to place the forks at a convenient height where articles picked from shelves on the aisle may be placed. On the other hand, the operator may wish to move a box or pallet onto the fork, and in this case, the load handler assembly is moved across the face of the operator's platform toward the load, and when it reaches its extended position, the forks themselves are extended and placed under the load, the forks raised to pick up the load, and the forks are then returned to their home position and the load handler assembly is itself is moved back to its home position, thereby to center the load relative to the vehicle.

In prior art stockpickers, the operator must first move the load handler assembly from its home position to the load side of the vehicle with one control handle and then, in a separate action, extend the forks using a separate control device. Further, stockpickers typically do not include mechanical means for holding the forks in the home position so that they might drift out of the home position as the vehicle is moving down the aisle, and any movement of the fork carriage assemble with the forks out of the home position could inadvertently cause damage.

SUMMARY OF THE INVENTION

This invention is directed to an improved fork extension and retraction system for use with turret stockpickers. Specifically, this invention provides an improved method and apparatus for automatically extending the forks after the load handler has moved to its limit traverse position, and for automatically retracting the forks if they have drifted from their home position before performing other fork related activities.

In the present invention, a turret stockpicker is provided with hydraulically extendable forks carried by the fork carriage assembly. Switches sense when the extendable forks are in the home position and near the home position. Other switches sense when the load handler assembly has reached its extended position o the load side or the operator's platform. Still other switches are used to slow the traverse movement of the load handler assembly as it approaches or leaves its limit position, either the home position or the extended position, thus to cushion the shock of the load handler stopping when engaging a mechanical stop. A control circuit senses the condition of these switches and controls the operation of both the load handle and the fork extension hydraulic system.

This is therefore an object of this invention to provide an improved apparatus for controlling the sequence of operations of the extendable forks of a turret stockpicker.

It is a further object of this invention to provide a turret stockpicker with extendable forks that will automatically extend upon the load handler assembly reaching its further movement in the direction of the forks without requiring the operator to manipulate additional controls, and thereafter to retract the forks and to move the load handler assembly across the stockpicker with a single control handle.

It is a still further object of this invention to provide an improved turret stockpicker wherein the extendable forks will be retracted automatically whenever the operator attempts to perform a load handler traverse maneuver if the forks have drifted more than a predetermined distance from their fully retracted position.

It is an additional object of this invention to provide an improved materials handling vehicle including a power unit for moving the vehicle, a platform assembly supported on the power unit including an operator's station and controls for operating various functions of said vehicle, a load handler assembly mounted for traverse movement across the platform assembly from a home position to a limit position, a traverse motor for moving said load handler assembly across the platform assembly, fork carriage assembly mounted on and vertically moveable relative to the load handler assembly, extendable forks carried by said fork carriage assembly and movable by fork extension cylinders, and a control handle for controlling the traverse movement of the load handler assembly, means responsive to movement of the control handle for controlling a supply of hydraulic fluid to power the traverse motor and to extend and retract the forks, means for sensing the direction of movement of the control handle, means for indicating the direction the load handler assembly is facing, limit switch means for sensing when the fork carriage assembly has moved to its limit position on either side of the platform assembly, transfer valve means for transferring hydraulic fluid between the traverse motor and the fork extension cylinders, circuit means responsive to said control handle sensing means, said limit switch means and said direction indicating means for controlling said transfer valve whereby the movement of the load handler assembly and the extendable forks will be automatic in response to movement of the control handle.

Other objects and advantages of the invention will be apparent from the following description, the accompanying drawings and the appended claims.

DESCRIPTION OF THE PREFERRED EMBODIMENT

Figure 1:
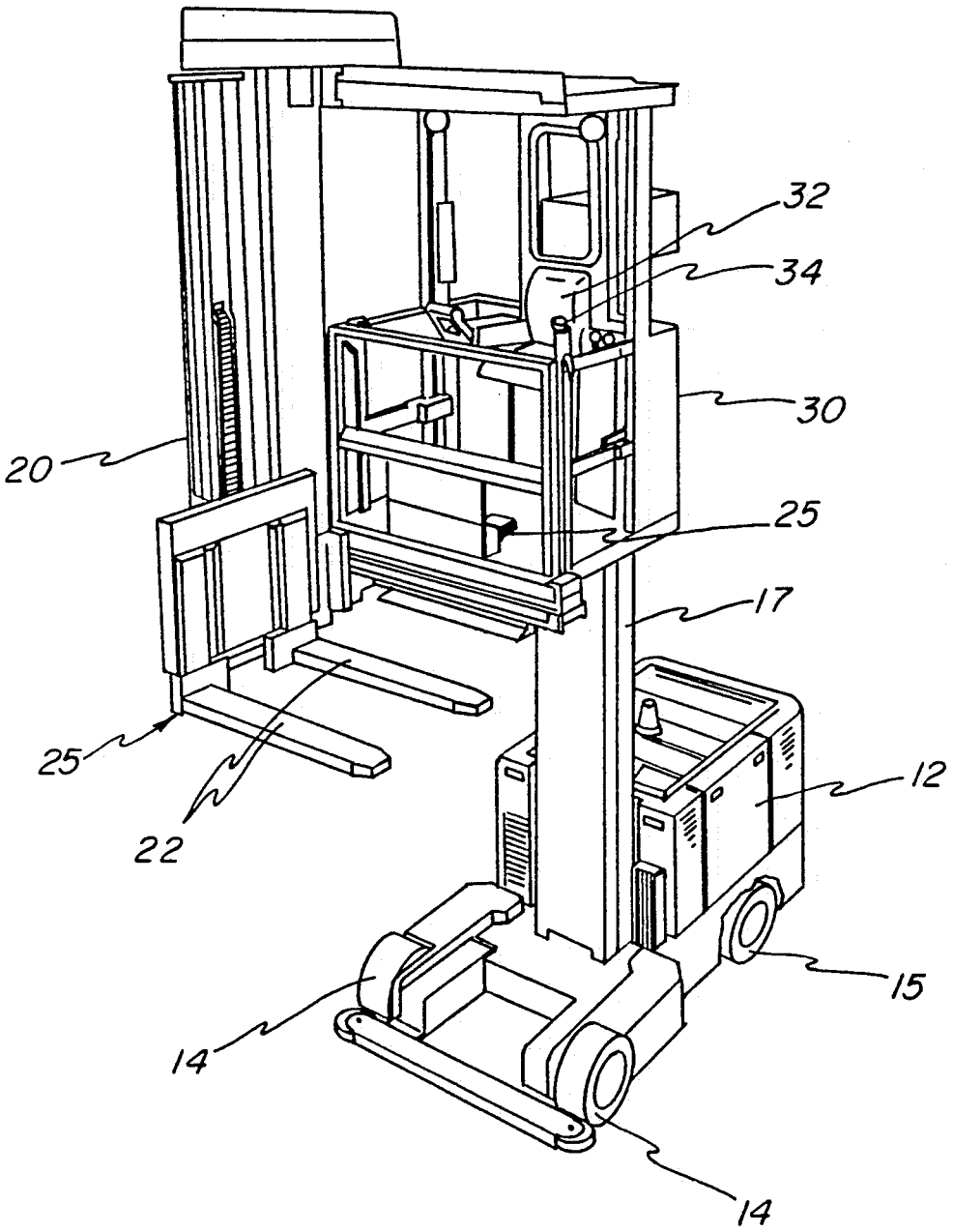
FIG. 1 is a perspective view of a turret stockpicker provided with the automatic fork extension and retraction system of this invention.
Figure 2:
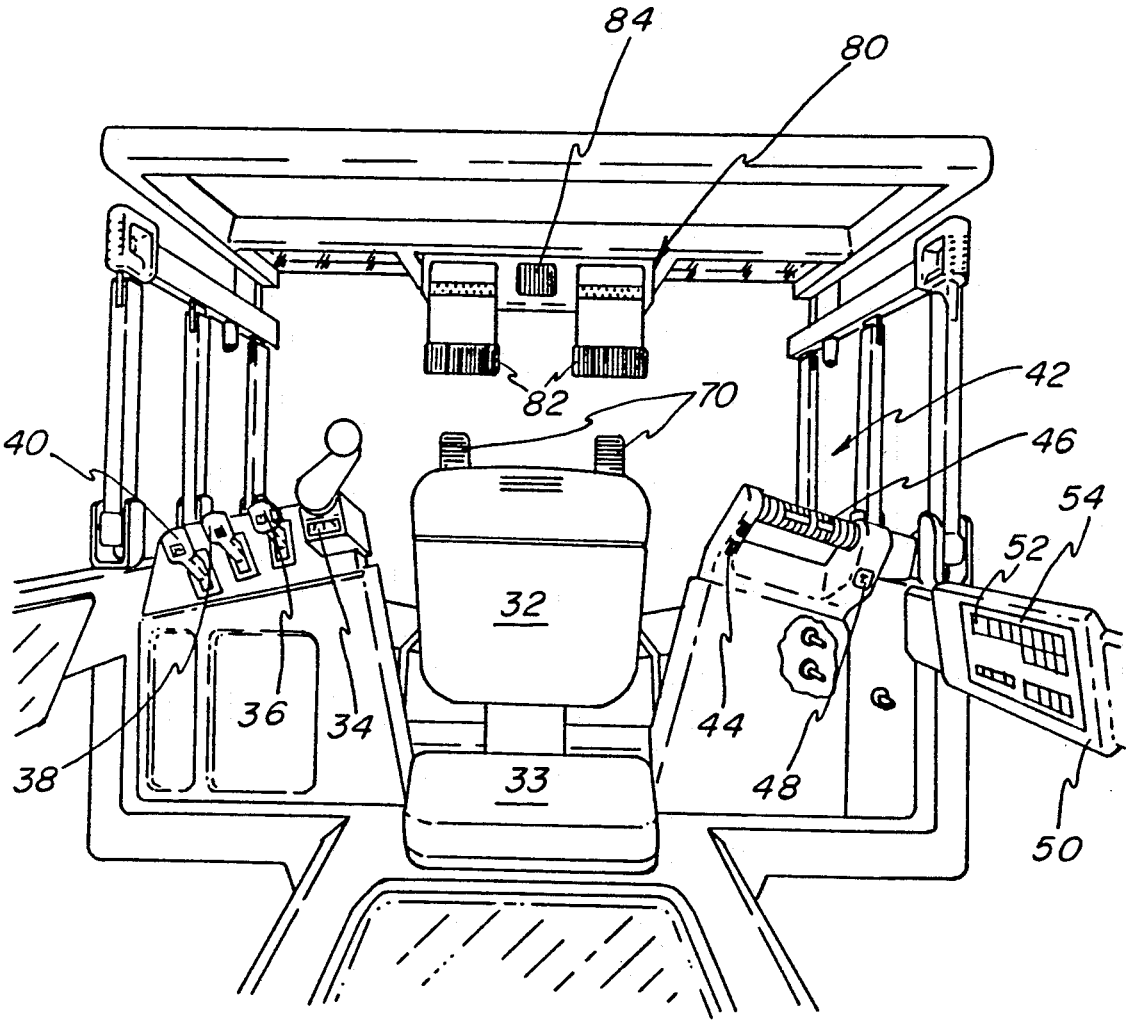
FIG. 2 is a plan view of the operator's platform and the various vehicle control handles.

Referring now to the drawings, and particularly to FIG. 1 which illustrates a materials handling vehicle, such as a turret stockpicker, the vehicle includes a power unit 10, a load handling assembly 20, and a platform assembly 30.

Figure 3:
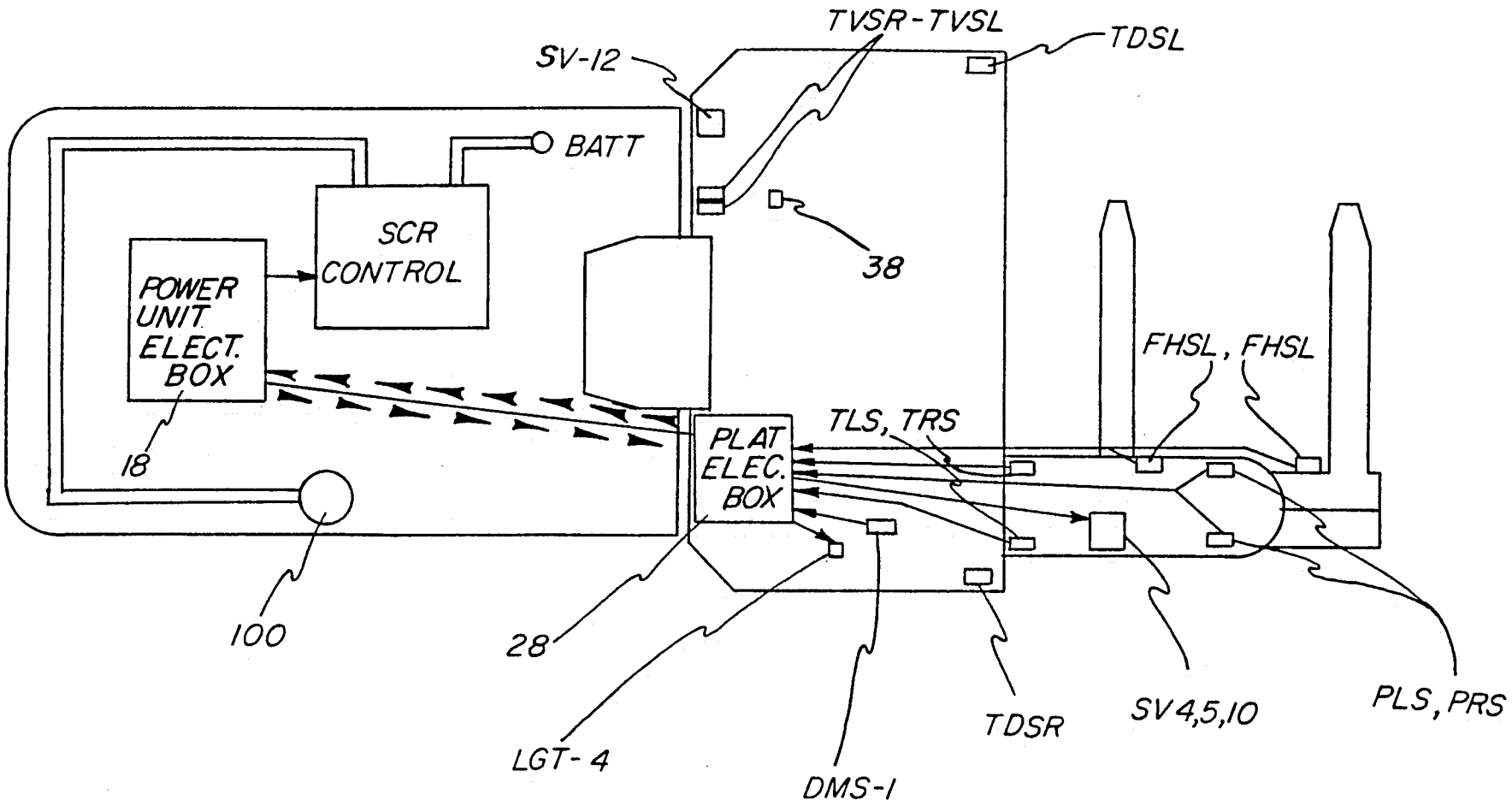
FIG. 3 is a simplified electrical diagram showing the various switches used in the present invention.

The power unit 10 includes a power source, such as a battery unit 12, a pair of load wheels 14 positioned under the platform assembly, a pair of steered wheels 15 positioned under the rear end of the power unit 10 with each wheel being driven by a traction motor, a mast 17 on which the platform assembly 30 rides, and a power unit electronic control unit 18 (FIG. 3)

The load handling assembly 20 includes a fork carriage assembly 25 which may be raised and lowered and also rotated relative to the load handling assembly. As shown in FIG. 1, the load handler assembly is in its home position on the right side of the platform. A pair of extendable forks 22 are carried by the fork carriage assembly. The fork carriage assembly may be raised from the position shown by means of an auxiliary lift cylinder 24 (FIG. 4) to place the forks at a convenient height for the operator to place individual packages on the forks, when the vehicle is being used in this mode, or to move the forks upwardly, without moving the platform assembly itself, when lifting pallets of boxes from a rack adjacent the aisle where the vehicle is operating.

The platform assembly 30 includes a seat 32, and back rest 33, from which the operator can operate various controls. A seat switch indicate whether the operator is seated or standing. On the left, the controls include a steering tiller 34, a fork raise and lower control 36, a fork traverse, retract and extend control 38, and a pivot control 40. On the right, the operator is provided with a traction motor control 42, which includes a horn switch 44, an accelerator twist grip and palm switch 46, and a power disconnect switch 48. An indicator control panel 50 to the right of the operator includes various indicator lamps and control switches, such as parking brake switch 54. The platform includes an electronics package 28 that is interconnected with the power unit electronics package 18 by means of a serial link through an appropriate cable.

If standing, the operator controls braking by releasing either of the foot pedals 70 located on the platform floor; dead man switches are also operated by the foot pedals for controlling auxiliary function of the vehicle. If seated, the operator uses the pedals located on the pedestal 80: dead man pedals 82 must be pressed for the operator to move the vehicle and perform certain control functions; braking is controlled by the service brake pedal 84.

The traverse control lever 38 is directly connected to and operates a control valve TCV (FIGS. 4 and 7) that controls the flow of hydraulic fluid to a traverse motor TM (FIG. 7) and to fork extension cylinders FEC. The control lever 38 also actuates a pair of switches TVSR and TVSL (FIG. 3) which are connected to the platform electronics package 28. Pushing the control lever 38 forward will cause the load handler to move across the platform to the left, and once it reaches its limit, to cause the forks to extend automatically. Pulling the control lever 38 to the rear will cause the forks to retract and then to move the load handler in the reverse direction until it reaches its home position. The forks may be pointed to either the right or left since the fork carriage assembly 25 may be rotated on the load handler assembly 20.

Figure 4:
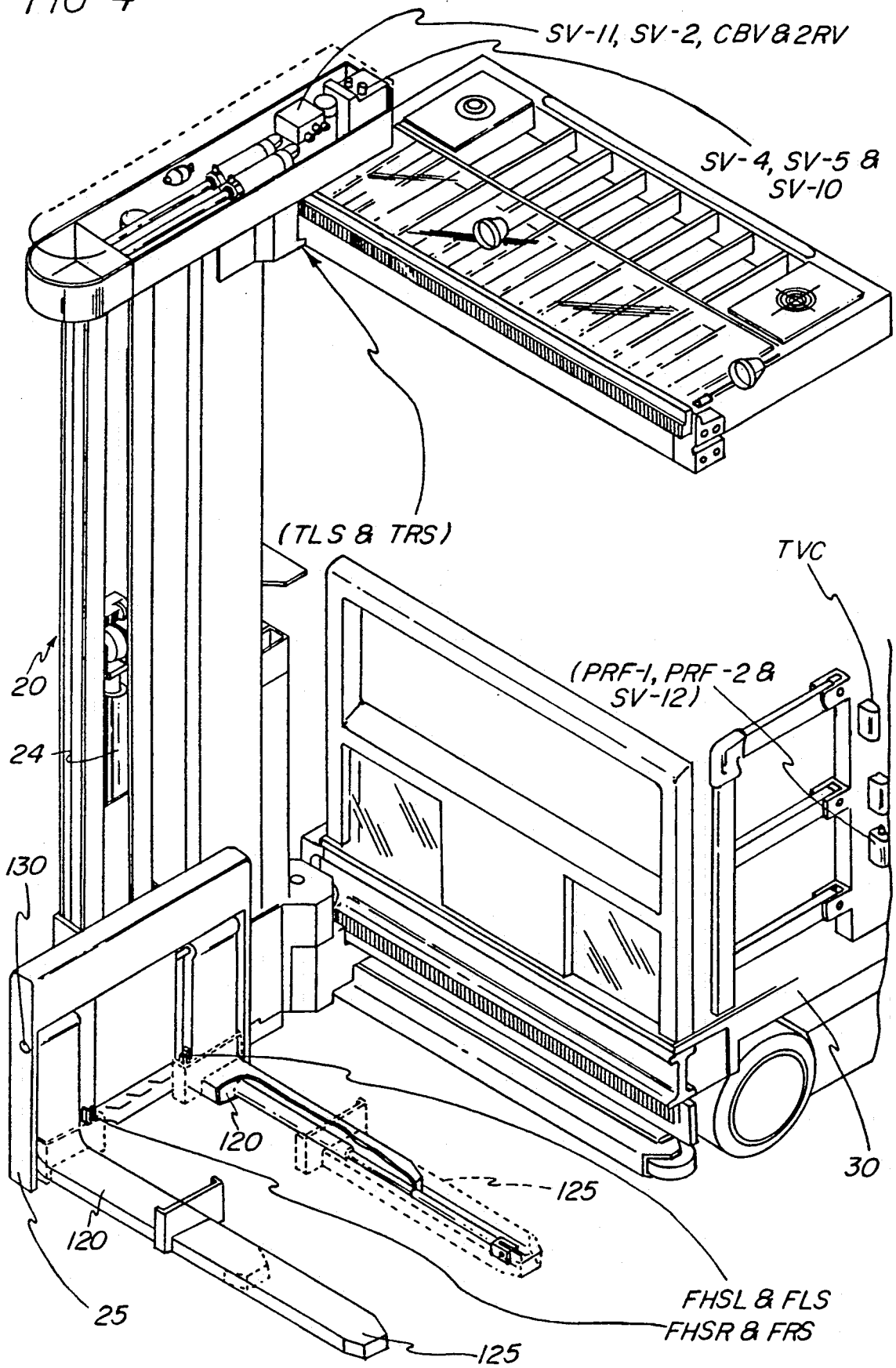
FIG. 4 is a simplified perspective view showing the location of the various position sensing switches used in connection with this invention.
Figure 5:
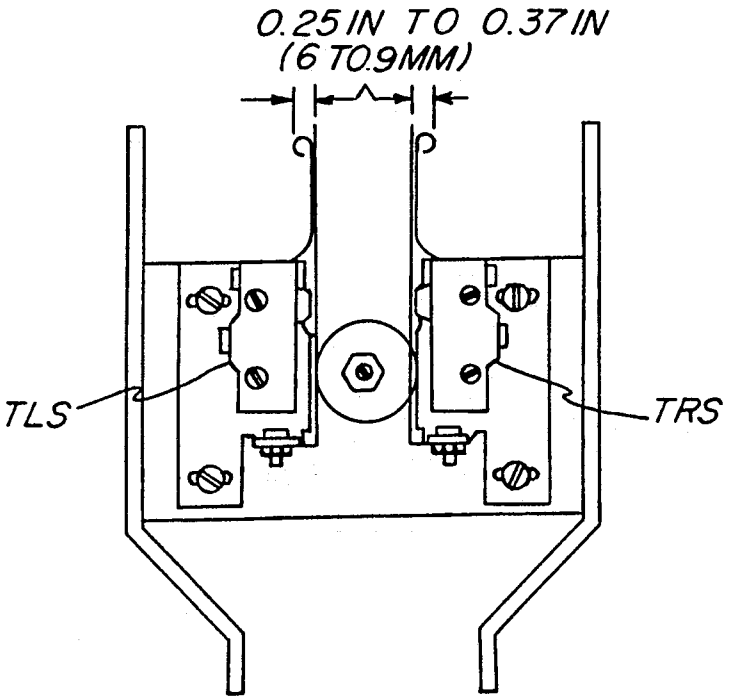
FIG. 5 is a plan view showing a detail of the traverse limit switches.

The position of the load handler assembly is monitored by two sets of electrical switches. The first set includes the traverse limit switches TRS and TLS which are mounted for movement with the load handler assembly itself and operated by actuators (not shown) located on the right and left side of the platform assembly 30. FIGS. 4 and 5 show the placement of the traverse limit switches at the upper portion of the load handler assembly, immediately below the platform support structure. These switches indicate when the load handler assembly is in its extreme or limit positions relative to the platform 30. The second set of switches include traverse slowdown switches TDSR and TDSL, mounted on the upper platform structure and actuated by the load handler assembly as it moves past the switch. These switches activate a valve that restricts the flow of hydraulic fluid to the traverse motor to cause the load handler assembly to slow prior to reaching its limit position. When the load handler assembly moves past the switch while moving in the reverse direction, the flow restriction will be removed.

Switches PRS and PLS, shown schematically in FIGS. 3 and 4, monitor the rotational position of the fork carriage assembly 25, and indicate whether it is pointed to the right or to the left.

The fork carriage assembly includes a pair of fork cylinder assemblies 120 each carrying sliding fork members 125. The fork cylinders assemblies 120 are pivotally attached to the fork carriage assembly at 130. The fork cylinder assemblies include a hollow interior functioning as a cylinder, a piston within the cylinder, and means for introducing hydraulic fluid to either side of the piston. Each fork cylinder assembly and associated piston comprise a fork extension cylinder FEC. Sliding fork members 125 are slideably supported on the fork cylinder assemblies and connected to their respective pistons. Introducing hydraulic fluid into the fork cylinder assemblies thus permits the sliding fork members to extend or retract, as desired.

Figure 6:
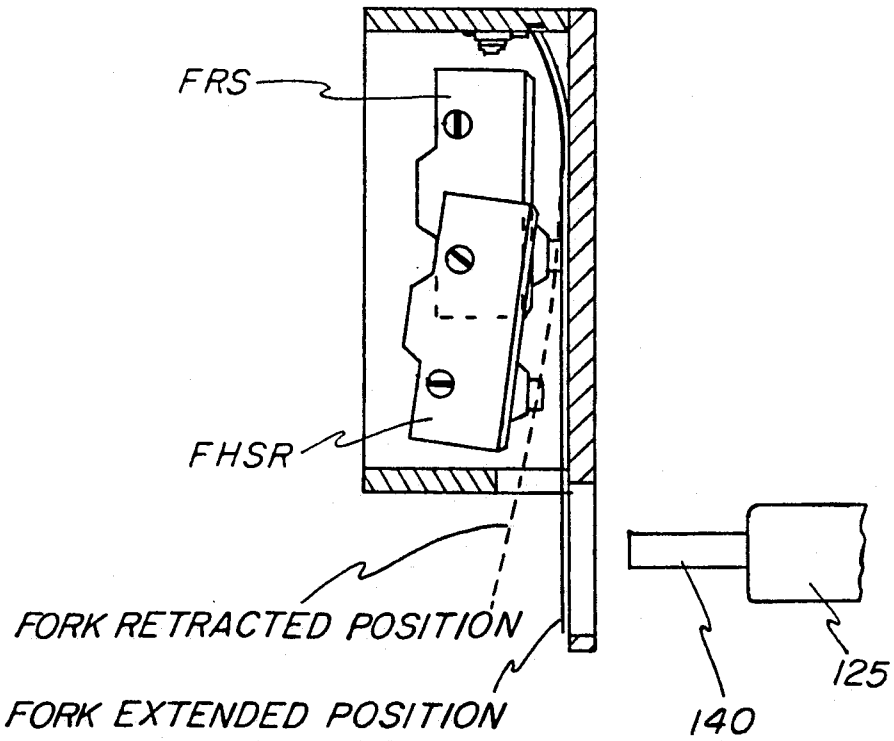
FIG. 6 is an elevational view showing a detail of a fork home and differential switch.

An actuator pin 140 (FIG. 6) is placed at the rear portion of each sliding fork member 125, and this pin 140 is used to operate a pair of switches associated with the home position of each sliding fork member. The right hand sliding fork member operates fork home switch FHSR and differential switch FRS while the left hand sliding fork member operates fork home switch FHSL and differential switch FLS. One set of switches is shown in FIG. 6.

The fork home switches are closed only when the sliding fork members are in their completely retracted or home position. Forward movement of the fork members 125 by as little as 0.5 inch will open the home switch. Should the hydraulic fluid not be able to hold the fork members in the true home position, the differential switch will permit the sliding fork members to drift outwardly by as much as one inch before opening.

Figure 7:
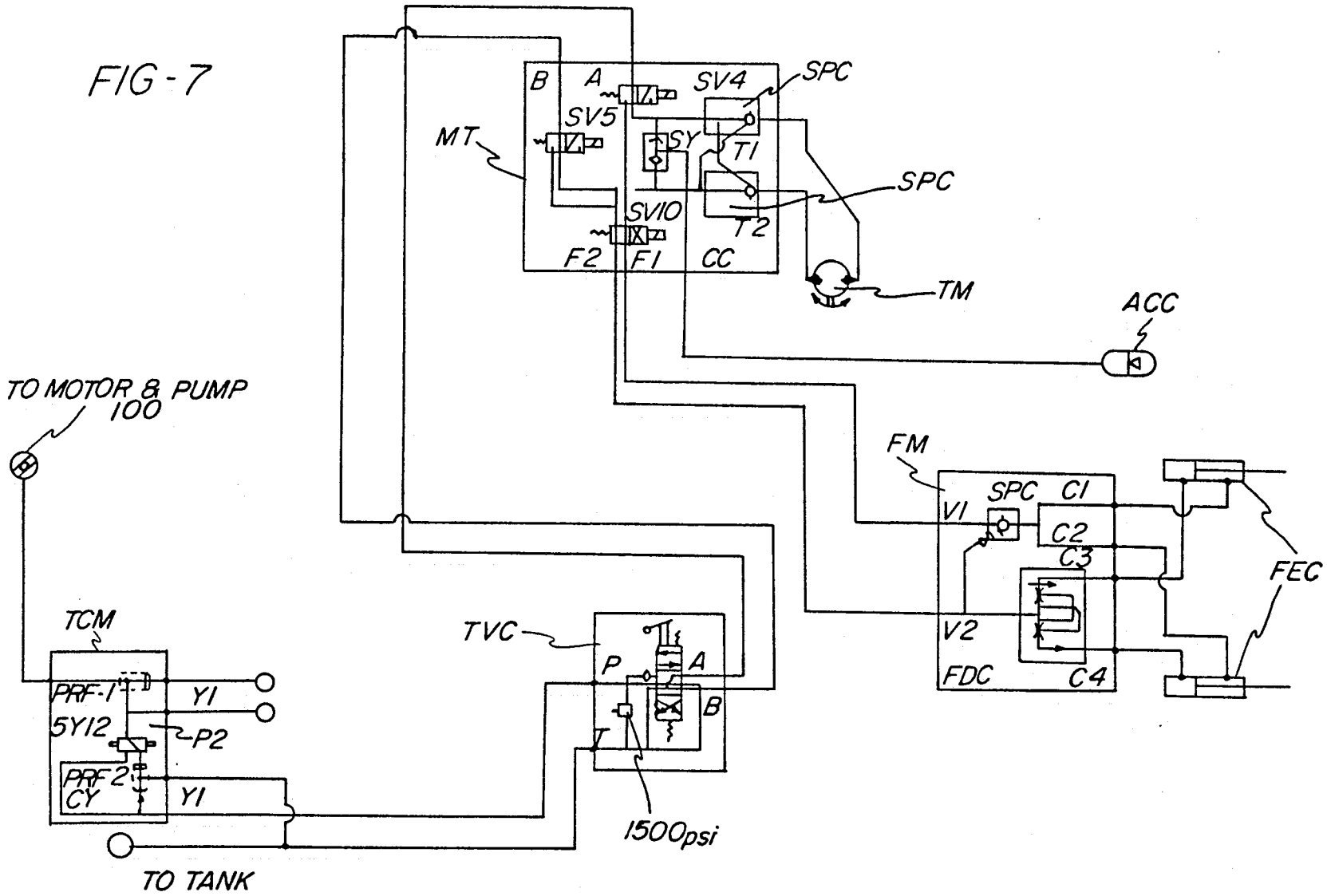
FIG. 7 is a hydraulic schematic diagram showing hydraulic components used in connection with the automatic fork extension and retraction system of this invention.

Referring now to the hydraulic schematic diagram of FIG. 7, hydraulic fluid under pressure is supplied by an accessory motor and pump 100 (FIG. 3) to a traverse cushion manifold TCM physically located near the traverse control valve TCV on the operator's platform 30. Hydraulic fluid from this manifold is supplied thought the control valve TVC to the traverse manifold MT. Hydraulic fluid from manifold MT will be supplied to either the traverse motor TM, to move the load handler assembly 20 across the face of the platform 30, or to the fork extension cylinders FEC through the fork manifold FM. An accumulator ACC connected to the traverse manifold provides a steady source of pressure to the traverse motor TM.

Figure 8:
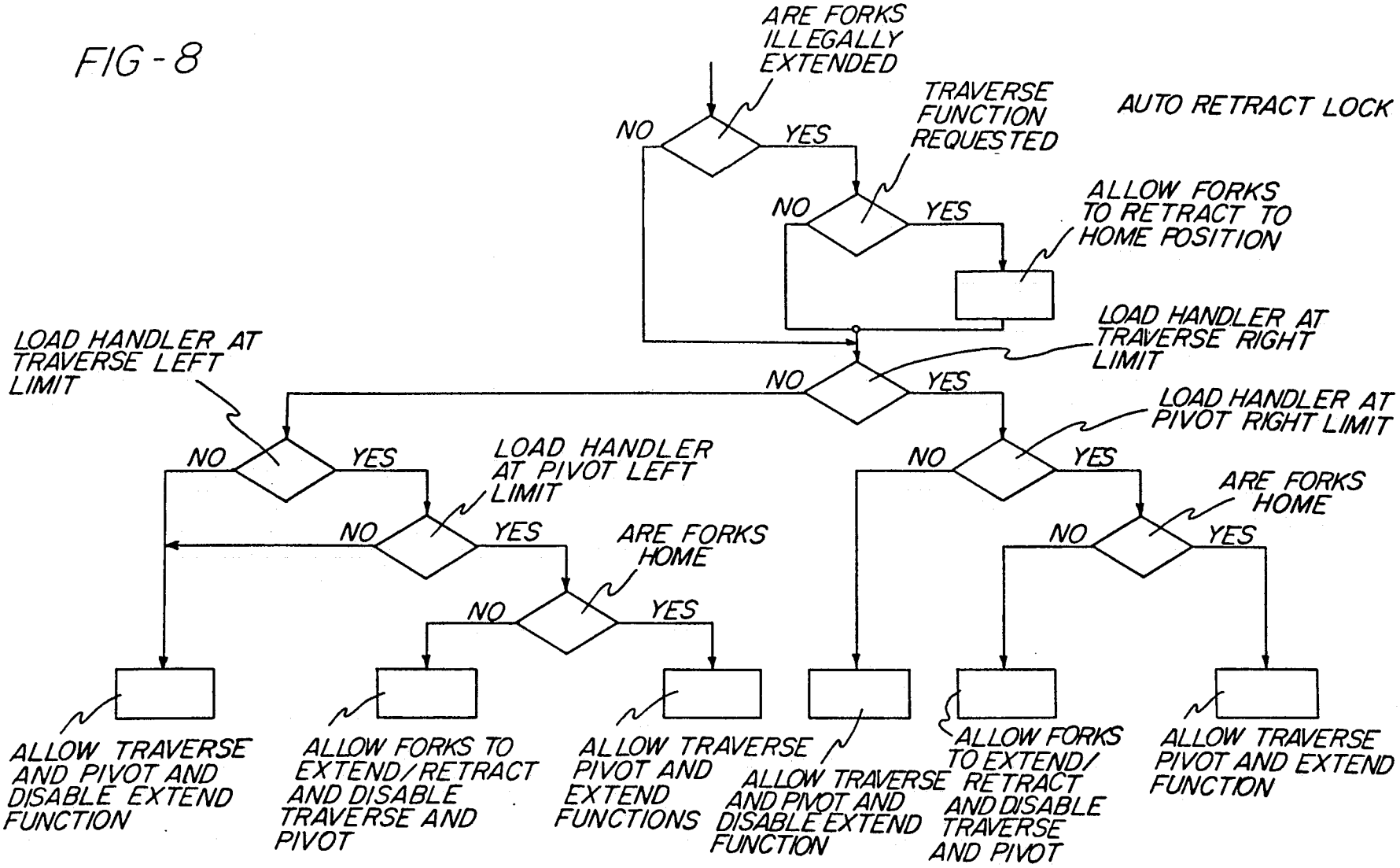
FIG. 8 is a decision flow chart of the automatic retract logic and the automatic fork extension logic functions.

The sequence of normal operations to be described is illustrated in the logic diagram of FIG. 8. In the following description of the operation of the fork traverse mechanism, it will be assumed that the load handler assembly 20 and the fork carriage assembly 25 are in the positions shown in FIG. 1, and in this case, the right traverse limit switch TRS is closed and the forks are in their retracted positions with the differential switches FRS and FLS closed and perhaps the fork home switches FHSR and FHSL also closed. The forks are pointing to the left (as viewed by the operator), as indicated by the pivot limit switches PRS and PLS. In other words, the load handler assembly 20 is in its right home position. It will also be assumed that the operator has closed the palm switch 46 and has operated the appropriate dead man switches so that this auxiliary function of the vehicle may be performed.

Figure 9:
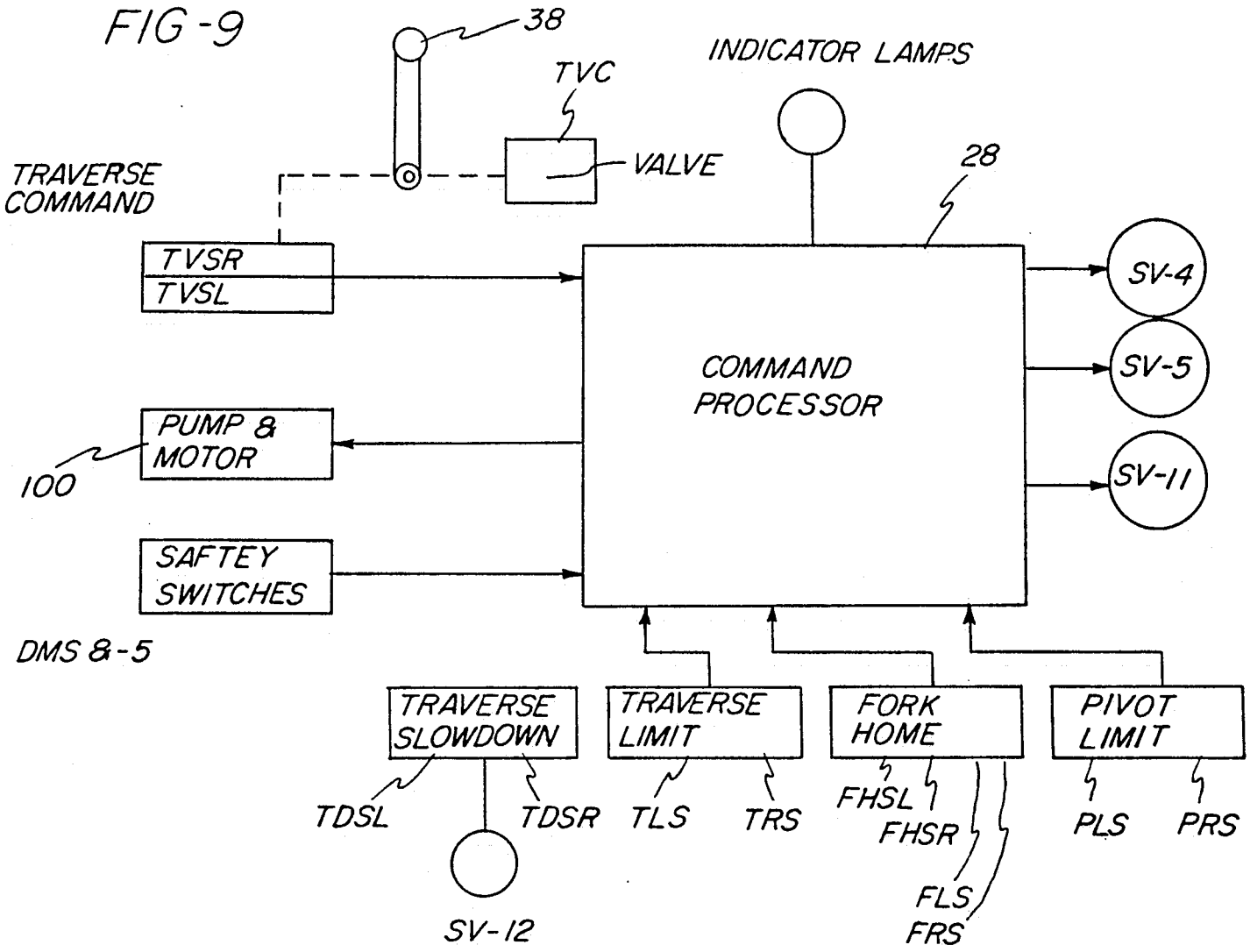
FIG. 9 is an electrical block diagram showing the major components comprising the present invention.

When the operator moves the traverse control handle 38 forward, two actions are taken, one electrical, the other hydraulic. Electrically, traverse command switch TVSR closes and this sends a signal to the command processor 28 (FIG. 9), indicating that traverse operation has begun. Hydraulically, hydraulic fluid is metered through the traverse control valve TVC to the traverse manifold MT to the traverse motor TM which rotates and drives the load handler assembly to the left. As the load handler assembly 20 approaches within 2 to 3 inches of the limit position, the left traverse slowdown switch TDSL will be activated and this will cause solenoid SV12 in the traverse cushion manifold TCM to deenergize and reduce the hydraulic flow to the motor TM and thus smoothly slow down the load handler assembly prior to reaching its stop. When the traverse limit switch TLS is actuated (upon the load handler assembly reaching the far left position), the command processor causes solenoids SV4 and SV5 in the traverse manifold MT to switch the flow of hydraulic fluid from the motor TM to the fork manifold and to the fork extension cylinders FEC.

At this time, the forks will extend automatically until they reach their mechanical limits. At this time, the operator will normally release the control handle 38, which will return by springs to its neutral position. The forks are now extended beyond the side of the stockpicker and are presumably under a load. The operator may perform an auxiliary lift to pick up the load a few inches by manipulating the control handle 36.

To retract the forks and the load, the operator will now pull the control handle 38 back, causing the traverse control valve TVC to reverse the flow of hydraulic fluid to the fork extension cylinders, retracting the forks until they reach the home position, as indicated by the switches FHSR and FHSL. When these switches close, the command processor will deenergize solenoids SV4 and SV5 in the traverse manifold MT, thereby redirecting hydraulic fluid to the traverse motor TM, this time rotating it in the opposite direction to move the load handler assembly 20 in the opposite direction. As the load handler assembly passes the left traverse slowdown switch TDSL, the flow restriction is removed and the load handler assembly is allowed to move at its maximum speed across the platform. Thus, after the forks have retracted, the initial movement of the load handler assembly will be at the restricted speed.

Again, as the load handler assembly approaches the end of its travel, traverse slowdown switch TDSR will activate to reduce the hydraulic flow to the motor TM, and when it reaches its home position, as indicated by traverse limit switch TLS, the traverse home light LGT4 will be turned on. The operator may then release the control handle and allow it to return to its neutral position.

If the forks drift out of their home position by more than approximately 0.5 inch, one or both of the fork home switches FHSR or FHSL will open. Since these switches are designed to indicate when the sliding fork members have fully retracted, no action will be taken. If the forks drift even further, however, one or both of the differential switches FRS or FLS will open. Under these conditions, if the operator attempts a traverse function, the command processor 28 will energize valves SV4 and 5 to provide hydraulic pressure to retract the forks to their home position.

Also included in the hydraulic circuit of the fork extension cylinders is a flow divider FDC for equally dividing the flow to each fork extension cylinder to maintain synchronized movement of the sliding fork members.

At any time the forks are extended, pivot blocking valve SV11 will be energized to prevent the fork carriage assembly from rotating or pivoting to a new position.

Switches PRS and PLS, along with the traverse limit switches TRS and TLS, determine whether the load handler assembly is in the right or left home position or in the limit (or ready-to-extend) position. This determines the status of a solenoid (SV10 in the traverse manifold MT) which controls the direction of hydraulic fluid flow to the fork extension cylinders. If the forks were pointing to the right, instead of to rhe left as shown, it would nevertheless be necessary to automatically extend or retract the sliding fork members, and for this reason, hydraulic fluid flow to the cylinders FEC is in the same direction even though the flow to the traverse motor will be reversed under these conditions.

While the form of apparatus herein described constitutes a preferred embodiment of this invention, it is to be understood that the invention is not limited to this precise form of apparatus and that changes may be made therein without departing from the scope of the invention, which is defined in the appended claims.

What is claimed is:

1. In a materials handling vehicle including a power unit for moving the vehicle, a platform assembly supported on and being vertically movable relative to the power unit including an operator's station and controls for operating various functions of said vehicle, a load handler assembly mounted for traverse movement across the platform assembly from a home position to a limit position, a traverse motor for moving said load handler assembly across the platform assembly, fork carriage assembly mounted on and vertically moveable relative to the load handler assembly, extendable forks carried by said fork carriage assembly and movable by fork extension cylinders, and a control handle for controlling the traverse movement of the load handler assembly, the improvement comprising means responsive to movement of the control handle for controlling a supply of hydraulic fluid to power the traverse motor and to extend and retract the forks, means for sensing the direction of movement of the control handle, means for indicating the direction the load handler assembly is facing, limit switch means for sensing when the fork carriage assembly has moved to its limit position on either side of the platform assembly, transfer valve means for transferring hydraulic fluid between the traverse motor and the fork extension cylinders, circuit means responsive to said control handle sensing means, said limit switch means and said direction indicating means for controlling said transfer valve whereby the movement of the load handler assembly and the extendable forks will be automatic in response to movement of the control handle.

2. The materials handling vehicle of claim 1 further including slowdown switch means for sensing the approach of the load handler assembly to its limit position, and means responsive to said slowdown switch means for reducing the flow of hydraulic fluid to the traverse motor prior to the fork carriage assembly engaging mechanical stop means.

3. The materials handling vehicle of claim 1 further including fork sensing means for indicating when the extendable forks are not in their home position, and wherein said circuit means will cause said forks to retract automatically upon any movement of the control handle.

* * * * *